US006065703A

United States Patent [19]

Ferrario et al.

[11] Patent Number: 6,065,703

[45] Date of Patent: May 23, 2000

[54] VERTICAL COIL WINDER FOR WINDING UP HOT ROLLED PRODUCTS

[75] Inventors: Giuseppe Ferrario, Legnano; Marco Rossini, Olgiate Olona, both of Italy

[73] Assignee: Techint Compagnia Technica Internazionale S.p.A., Milan, Italy

[21] Appl. No.: 09/122,862

[22] Filed: Jul. 27, 1998

[30] Foreign Application Priority Data

Jul. 28, 1997 [IT] Italy ..... MI97A1792

[51] Int. Cl.[7] ..... B21C 47/02; B21C 47/24

[52] U.S. Cl. ..... 242/362.3; 242/362; 72/142; 72/148; 140/124

[58] Field of Search ..... 242/362.3, 361.5, 242/361.3, 362; 72/142, 148; 140/124

[56] References Cited

U.S. PATENT DOCUMENTS 1,477,687 12/1923 Brown ..... 242/362.3

2,135,913 11/1938 Ralston et al. ..... 242/362.3

*Primary Examiner*—John Q. Nguyen

*Attorney, Agent, or Firm*—Oblon, Spivak, McClelland, Maier & Neustadt, P.C.

[57] ABSTRACT

A vertical coil winder for winding hot rolled products. A reel includes a cylindrical container and a plurality of vertical rods provided within the container. A gap is defined between the container and the rods to receive a hot rolled product which is wound due to the rotation of the reel. The rods can move in the radial direction between an expanded position for winding the product and a withdrawn position for extracting the coil.

5 Claims, 5 Drawing Sheets

VERTICAL COIL WINDER FOR WINDING UP HOT ROLLED PRODUCTS

BACKGROUND OF THE INVENTION

1. Field of the Invention

The present invention refers to a vertical coil winder suitable to wind a hot rolled material, as for instance metallic wires.

A coil winder for said use is, for instance, described in the Italian patent no. 673654.

2. Discussion of the Background

The skilled in the art know very well coil winders comprising a reel which has a structure formed by a cylindrical container, the so called "basket", inside which a plurality of vertical rods, positioned along a circumference, is provided.

A gap is therefore formed between the outer wall of the cylindrical container and said rods, wherein the metallic wire (or other hot rolled products), coming from the upstream roll mill, is placed and wound thanks to the rotation of the reel.

For obvious productivity reasons, the need to provide heavier coils, and, as a consequence, taller coils is more and more felt.

However, such a need increases the already existing problems in extracting easily and without problems the coil from the reel.

The problems in extracting the coil from the reel are mostly related to the progressive cooling of the hot material during the winding operation, said cooling causes a decrease in the length of said material, thus causing the tight locking of said material on the rods of the reel.

This is the fact that causes the problems in extracting the coil, additionally, said extracting operation has to be done right after the completion of the winding operation in order not to worsen the problems created by the progressive cooling of the material.

In order to overcome this problem, it has already been proposed to manufacture coil winders, provided with rods converging towards the upper portion of the reel, i.e. towards the inlet side of the hot rolled material, said side is also the side wherefrom the finished coil is extracted.

However, this proposal has not produced fully satisfactory results, since the slant of the rods cannot go beyond a certain angle, to avoid to obtain internally conical coils (i.e. with coils having a decreasing diameter going from the bottom to the top) not always acceptable on the market. As a consequence, even the use of converging rods has not satisfactorily solved said problem, since said use did neither eliminate the significant forces needed to separate the coil from the rods nor the internally conical coils.

In addition, even in this case, if for production or accidental reasons, the coil extracting operation cannot be performed immediately after the completion of the winding operation of the hot product, the coil undergoes a further cooling thus developing such forces that unusual means (as for instance a crane) shall be required to extract the coil from the reel.

SUMMARY OF THE INVENTION

A purpose of the invention is then to overcome the problems of the known art by manufacturing an improved coil winder provided with a reel structured in such a way that the finished coil can be easily extracted from said reel.

Said purpose is achieved by a coil winder having the features indicated in the accompanying claims.

BRIEF DESCRIPTION OF THE DRAWINGS

The structural and functional features of the invention, as well as its advantages in comparison with the known art, will be more clearly understood from an analysis of the following description, referred to the accompanying schematic drawings, wherein two examples of embodiment are shown. In the drawings.

DETAILED DESCRIPTION OF THE PREFERRED EMBODIMENTS

Referring to FIGS. 1–4 of the drawings, the vertical coil winder according to the invention comprises a reel, indicated by numeral 10, which has a structure formed by a cylindrical coil 11, the so called "basket", with a closed bottom base 12 and an open top.

Figure 1:
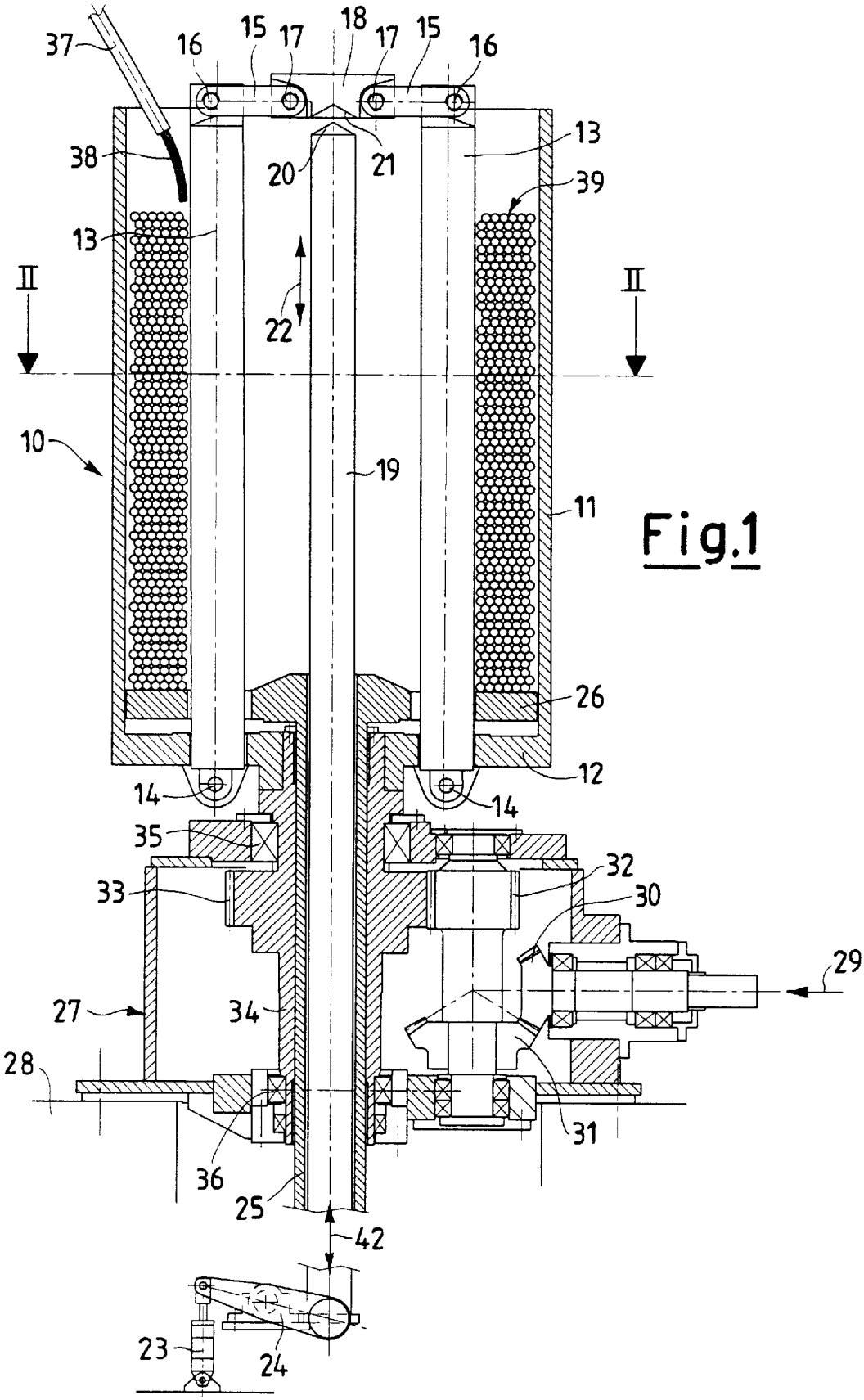
FIG. 1 is a vertical sectional view showing a first possible embodiment of a coil winder according to the invention with the reel vertical rods in the radially expanded working position during the coil formation.
Figure 3:
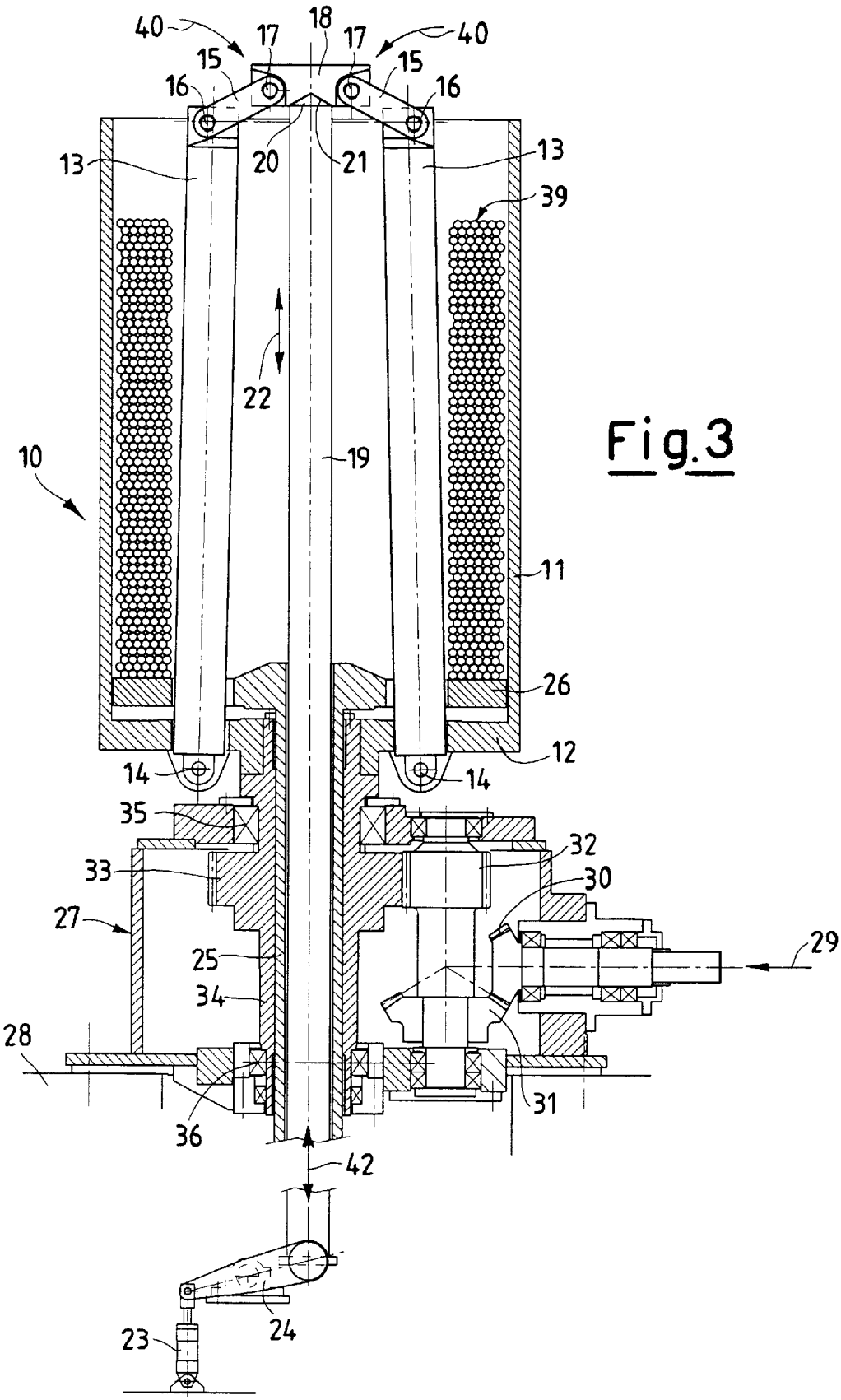
FIG. 3 is a sectional view as in FIG. 1, but showing the reel rods in the withdrawn position to allow the extracting operation of the finished coil.

A plurality of vertical rods 13 extend from the base 12 of the container 11, said rods being within said container, and each rod is pivoted in 14 to said base 12, so as to rotate between the expanded position of FIG. 1 and the withdrawn position of FIG. 3.

Figure 2:
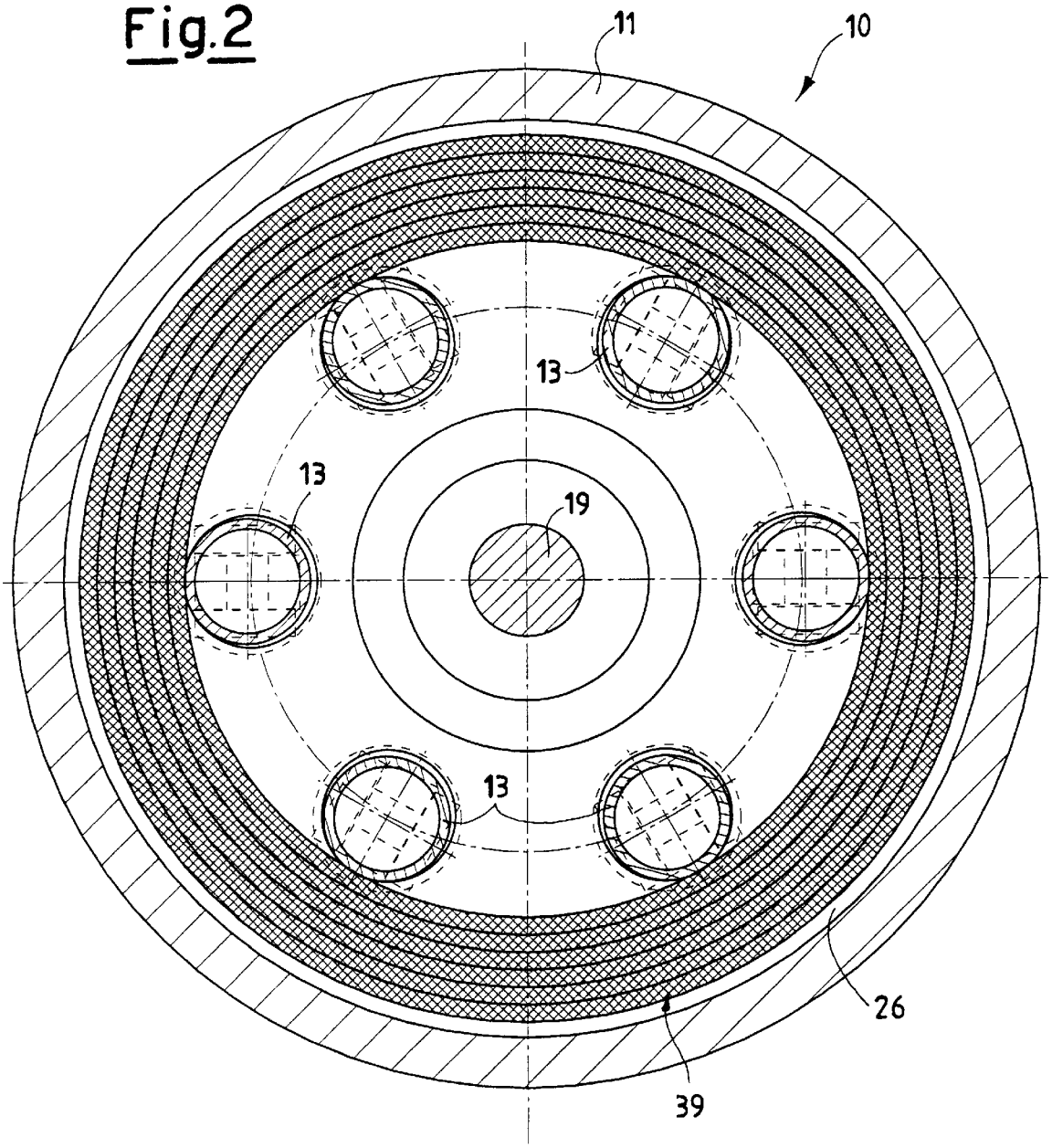
FIG. 2 is an enlarged sectional view taken along the plane II—II of FIG. 1.

As is clearly shown in FIG. 2 of the drawings, in the shown example, there are six rods 13, but there could be less or more.

Substantially, the rods 13 extend up to the top of the container 11 and are connected by articulated links 15. Each one of said links 15 is pivoted in 16 to the top end of a corresponding rod 13 and is pivoted in 17 to a central driving plate 18.

A control stem 19 co-operates with said plate 18, said stem having at its free end a tip 20 which engages a corresponding cavity 21 formed on the lower surface of the plate 18.

Said control stem 19 can be driven to move along an axial direction indicated by arrow 22, for instance by means of a control hydraulic circuit 23 connected to said stem through a lever system 24.

As is clearly shown in the drawings, the stem 19 passes, with a clearance, through a sleeve 25 of an extractor device 26 mounted on the bottom of the cylindrical container 11.

The reel 10 is driven for rotation by a motor (not shown) connected to a reduction unit 27 mounted on a structure 28.

The motion, having the inlet direction of arrow 29, is transmitted through a bevel gear pair 30, 31 and through a pair of geared wheels 32, 33 to a sleeve 34 which is rigid with the bottom 12 of the cylindrical container 11.

Said sleeve 34 can rotate on the bearings 35, 36. A feeding duct, schematically indicated by 37, for a hot rolled product, as for instance a metallic wire 38, coming from an upstream roll mill, wherein said metallic wire has to be wound on the reel 10, so as to form a commercial coil 39. According to the invention, the way the coil winder works is clear from the above description with reference to the figures, and is briefly explained hereinafter.

The wire 38 is wound inside the container 11, according to a known technique, through continuous rotation of the reel 10, which has the articulated rods 13 in the radially expanded working position shown in FIG. 1. During the rotation of the reel 10, the control stem 19 is stationary.

Once the coil 39, with the required weight and height, is finished, as shown in FIG. 3, the rods 13 are radially withdrawn through an upward movement of the stem 19 which pushes the plate 18, thus causing a rotation of the rods 13 around 14 in the direction of the arrows 40, i.e. towards the axis of the container 11.

Figure 4:
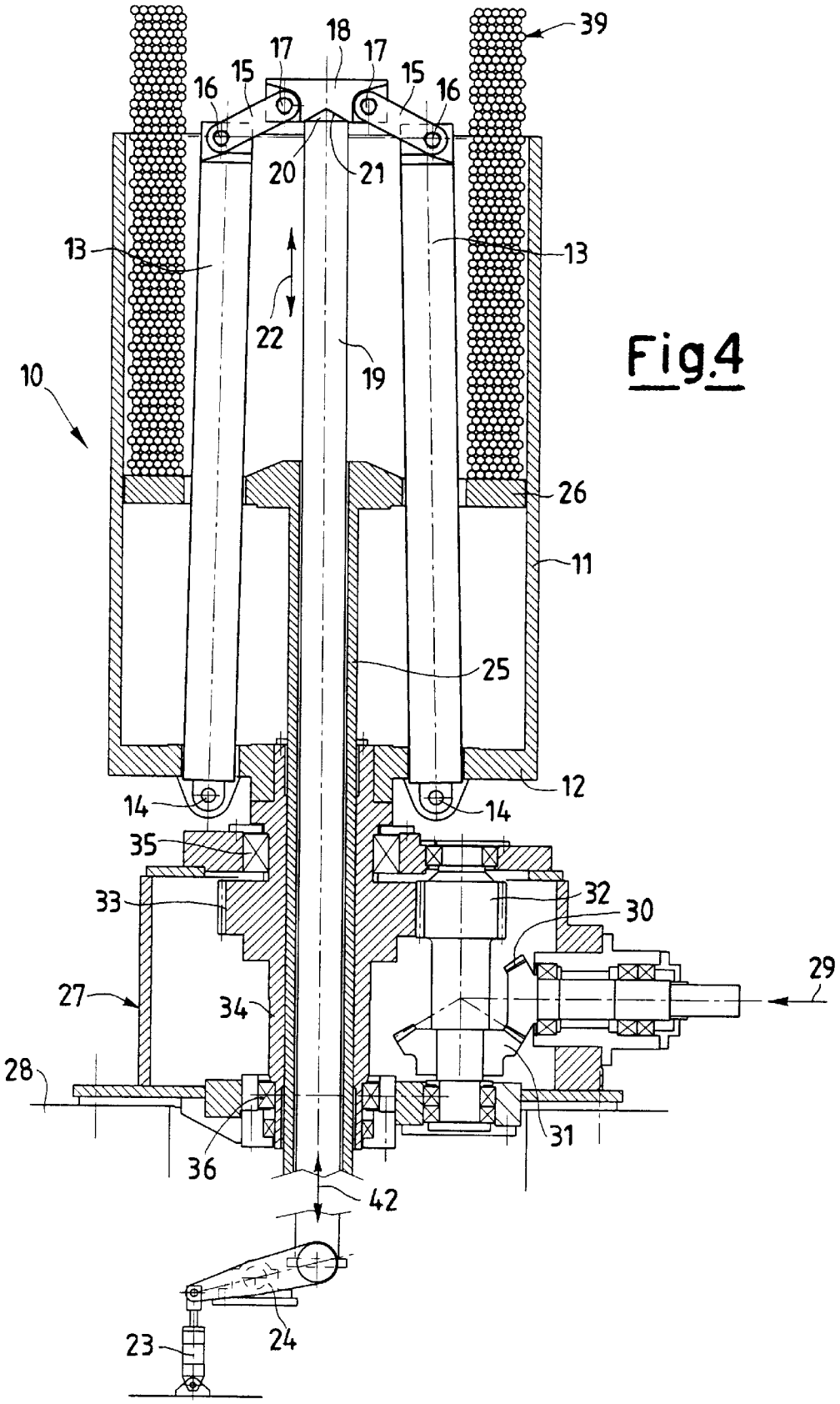
FIG. 4 is a sectional view, as in FIG. 3, showing the extracting phase of the finished coil.

In this way, the rods 13 are detached from the coil 39 during the cooling phase, thus allowing the easy extraction of said coil, as shown in FIG. 4, by moving upwards the extractor device 26. The control system of said extractor device 26 can be of any type suitable to the purpose and well-known to the skilled in the art, said device being not shown in order to simplify the drawing and simply indicated by arrow 42. By moving back the stem 19 to the position of FIG. 1 through force of gravity, also the plate 18 and the links 15 will go back to the same position.

Figure 5:
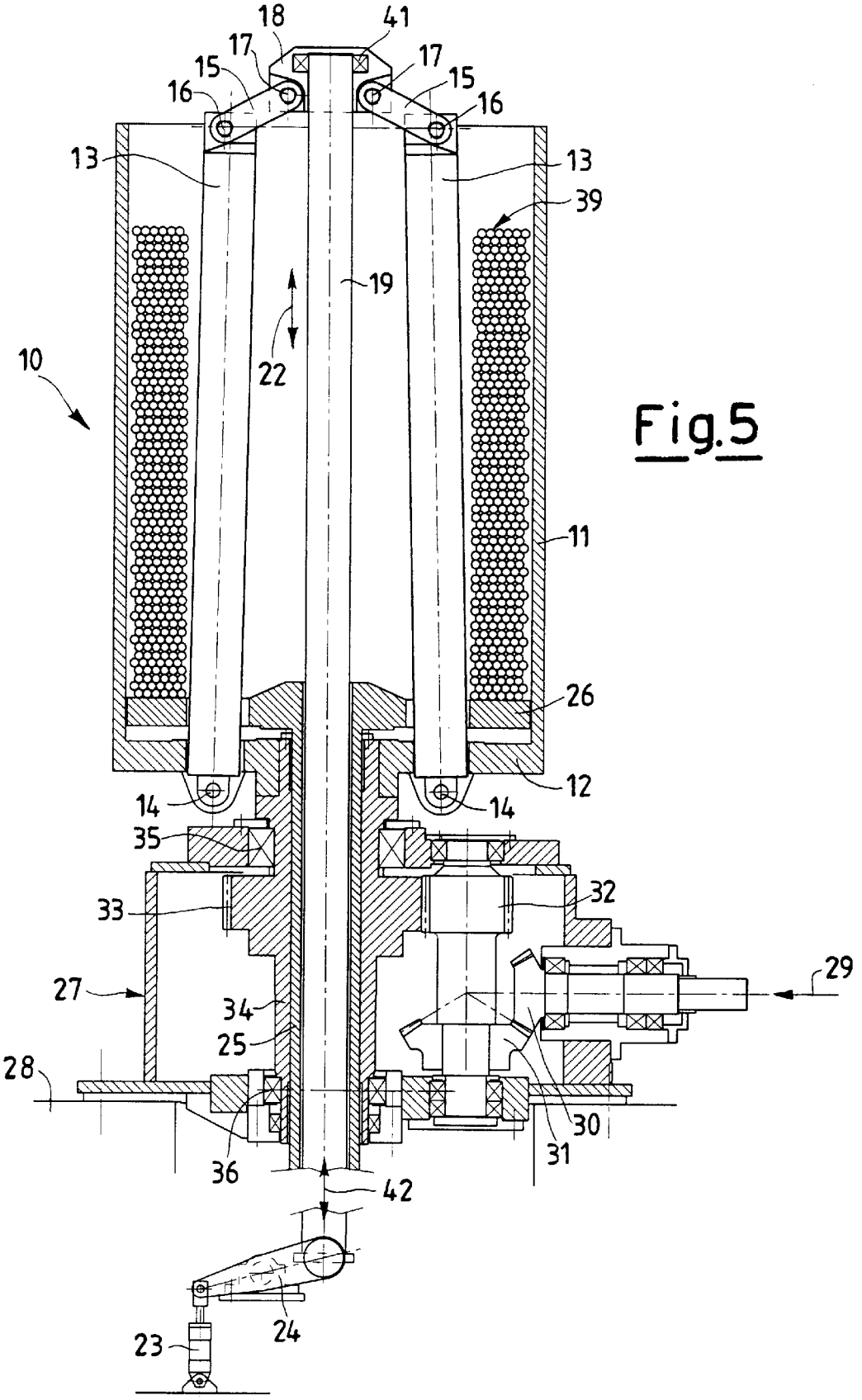
FIG. 5 is a sectional view as in FIG. 3, but showing a second possible embodiment of the invention.

According to the embodiment shown in FIG. 5, the control stem 19 can also be engaged to the plate 18, which rotates by means of the bearings 41 thereon.

Therefore, the purpose mentioned in the description preamble has been achieved, i.e. to provide a coil winder suitable to produce coils having weights and heights in excess of the usual standards, without jeopardising the extraction operation of said coils, said operation being improved by the expanding structure of the rods 13 which form the reel core.

What is claimed is:

1. Vertical coil winder, for winding hot rolled products, of the type comprising a reel which has a structure formed by a substantially cylindrical container, and a plurality of vertical rods circumferentially positioned being provided within said container, whereby a gap is defined between said container and said rods wherein a hot rolled product is placed and wound thanks to the rotation of said reel, characterized in that said plurality of rods are structured to move in the radial direction between an expanded position, wherein said product is wound, and a withdrawn position, wherein the finished coil is extracted, said vertical rods being pivoted at one end to the bottom of said container, while at the opposite end, said rods are connected through a lever system driven by a drive means.

2. Coil winder as claimed in claim 1, characterised in that said rods pass through an extractor device whereon the coils, to be wound, of the hot rolled material are placed, said extractor device can be moved between a lowered non working position and a lifted working position, wherein the coils are extracted.

3. Coil winder as claimed in claim 1, characterised in that said lever system comprises a central plate connected through articulated joints to the rods by means of links which, at one end, are pivoted to the top of a rod and, at the other end, are pivoted to the central plate, and that said drive means is formed by a stem which can be moved forth and back.

4. Coil winder as claimed in claim 3, characterised in that said stem engages, through a tip of said stem, a corresponding cavity of the plate.

5. Coil winder as claimed in claim 3, characterised in that said plate is connected to said stem since it rotates thereon by means of bearings.

* * * * *

UNITED STATES PATENT AND TRADEMARK OFFICE

CERTIFICATE OF CORRECTION

PATENT NO. : 6,065,703

DATED : May 23, 2000

INVENTOR(S): Giuseppe FERRARIO, et al.

It is certified that an error appears in the above-identified patent and that said Letters Patent is hereby corrected as shown below:

Item [ 73 ], the Assignee information is listed incorrectly. Item [ 73 ] should read as follows:

--- [73] Assignee: Techint Compagnia Tecnica Internazionale S.p.A.,

Milan, Italy ---

Signed and Sealed this

Tenth Day of April, 2001

*Attest:*

Nicholas P. Godici

NICHOLAS P. GODICI

*Attesting Officer*

*Acting Director of the United States Patent and Trademark Office*